United States Patent [19]

Phillips

[11] Patent Number: 4,649,798

[45] Date of Patent: Mar. 17, 1987

[54] GUN SILENCER USING INTERNAL REFLECTANCE

[76] Inventor: David E. Phillips, 618 Camelot Dr., Bel Air, Md. 21014

[21] Appl. No.: 755,530

[22] Filed: Jul. 16, 1985

[51] Int. Cl.[4] ..... F41C 21/18; F01N 1/00

[52] U.S. Cl. ..... 89/14.4; 181/223; 181/255

[58] Field of Search ..... 89/14.4; 181/223, 247, 181/255

[56] References Cited

U.S. PATENT DOCUMENTS

| | | | |
|---|---|---|---|
| 989,158 | 4/1911 | King | 89/14.4 |
| 1,207,264 | 12/1916 | Bailey | 89/14.4 |
| 3,051,057 | 8/1962 | Ivy | 89/14.4 |

OTHER PUBLICATIONS

"Parts & Accessories", catalogue No. 451D, 1985, J. C. Whitney and Co., Chicago, IL, p. 137.

*Primary Examiner*—Deborah L. Kyle
*Assistant Examiner*—Michael J. Carone
*Attorney, Agent, or Firm*—Saul Elbaum; Alan J. Kennedy; Thomas E. McDonald

[57] ABSTRACT

The present gun silencer includes an internal cardioid-shaped cavity which utilizes the principles of wave mechanics to attenuate the sound of a gun firing without contacting the projectile. The shock wave from a firing is totally internally reflected thereby confining and attenuating the sound from a gun firing. The silencer cavity is shaped in a manner guiding and concentrating shock waves from a gun firing to an exit port at which sound-absorbing material is present.

9 Claims, 1 Drawing Figure

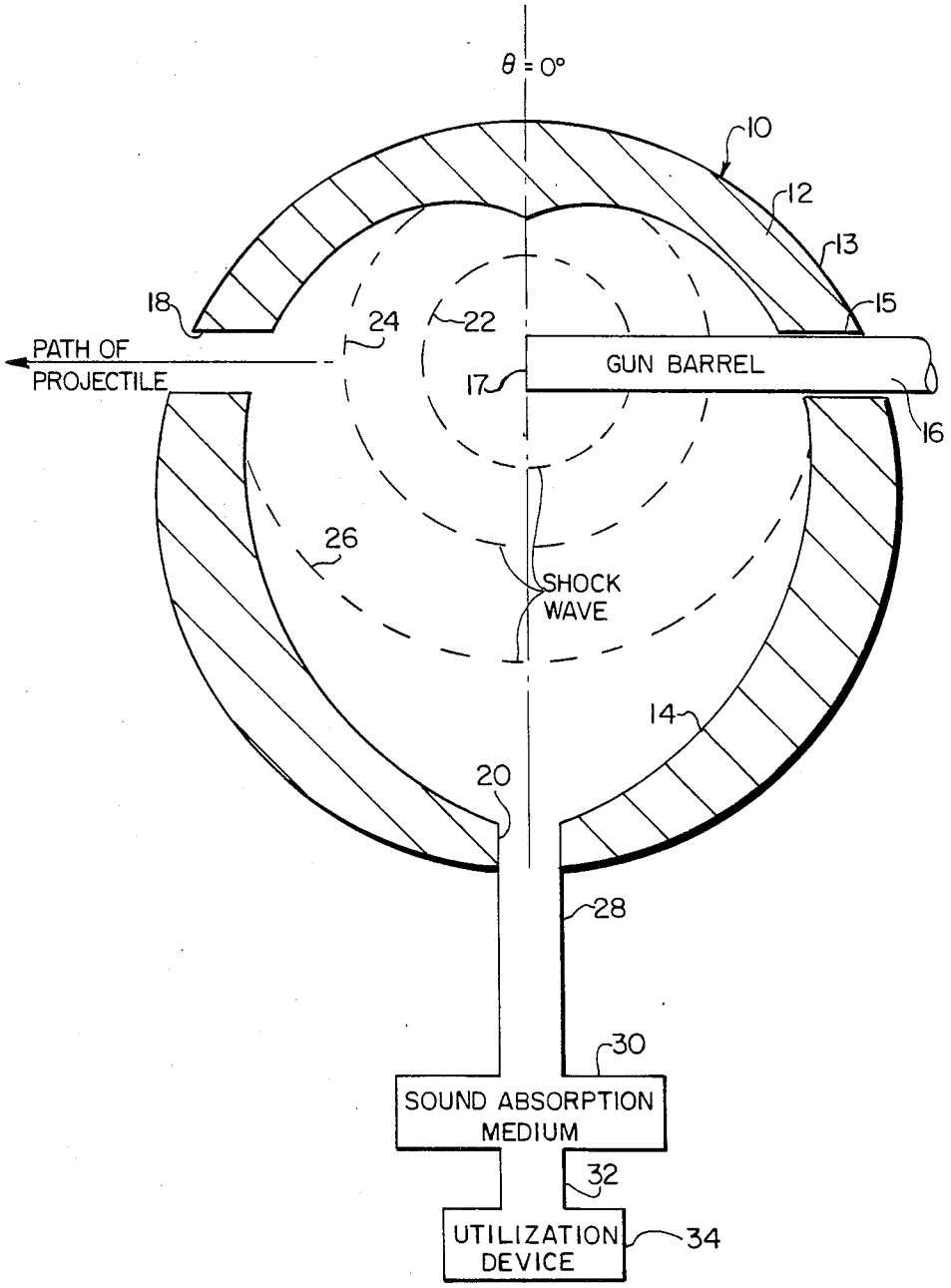
θ = 0°
10
12
13
15
18
24
22
PATH OF
PROJECTILE
GUN BARREL
17
16
26
SHOCK
WAVE
14
20
28
30
SOUND ABSORPTION
MEDIUM
32
UTILIZATION
DEVICE
34

GUN SILENCER USING INTERNAL REFLECTANCE

RIGHTS OF THE GOVERNMENT

The invention described herein may be manufactured, used, and licensed by or for the United States Government for governmental purposes without the payment to me of any royalty thereon.

FIELD OF THE INVENTION

The present invention relates to gun silencers, and more particularly to a silencer which utilizes the principals of internal reflection of a shock wave to attenuate noise.

BACKGROUND OF THE INVENTION

The prior art is replete with gun silencer constructions which have as a primary purpose the lowering of sound levels caused by gun firing.

Although many gun silencer devices operate satisfactorily to accomplish the intended function, they often affect the performance of a weapon by decreasing the velocity or otherwise adversely affecting the flight path characteristics of a fired projectile.

BRIEF DESCRIPTION OF THE PRESENT INVENTION

The present invention achieves the primary purpose of gun silencing without adversely affecting the velocity or flight characteristics of a fired projectile.

The present invention utilizes the principle of wave mechanics to attenuate the sound of a gun firing without requiring contact between a fired projectile and any portion of the gun silencer. More particularly, the invention relies upon the principle of internal reflection of a shock wave at the interface of the air within the silencer and the walls of the silencer. The internally reflected shock waves from a gun firing are concentrated and guided to an exit port in the silencer where sound-absorbing material is present. The exit port may also be connected to a conduit permitting the sonic energy of a gun firing to do useful work such as small arms bolt movement.

BRIEF DESCRIPTION OF THE FIGURE

The above-mentioned objects and advantages of the present invention will be more clearly understood when considered in conjunction with the accompanying drawing, in which:

The FIGURE is a cross-sectional view of the present gun silencer.

DETAILED DESCRIPTION OF THE INVENTION

The present invention satisfies the requirement that the silencing effect is not accompanied by a decrease of projectile velocity or dissipation of the round. The gun silencer of the present invention utilizes the wave mechanics principle of total internal reflection to direct a resulting shock wave into a sound-absorbing medium.

The gun silencer is characterized by an internal cavity described by the formula $r=r_0e^{\theta/\tan(\text{arcsine } V_1/V_2)}$ where $\theta$ is defined between 0 and 180° along the axis indicated in the FIGURE. The formula describes an internal cavity which is generally cardioid shaped and wherein the contour of the cavity is symmetrical about the illustrated axis.

In the above formula r is the radius, $r_0$ is a scaling factor equal to the minimum radius, e is the base of natural logarithms, $\theta$ is the angle, $V_1$ is the velocity of sound in air, and $V_2$ is the velocity of sound in the walls of the silencer (i.e., steel or aluminum).

Referring to the FIGURE the silencer is generally indicated by reference numeral 10 and is seen to include a metal wall 12 having a generally spherical external surface 13. The shape of the internal cavity 14 of the silencer is as described by the above-indicated formula. An opening 15 is formed within the silencer wall 12 to permit insertion of gun barrel 16. The firing end of the barrel is positioned at 17, centered on the zero radius point for the internal cavity. Colinear with opening 15 is a second opening 18, formed in wall 12, which permits exit of a fired projectile from the silencer.

When a gun is fired, a shock wave is generated at an initial moment of time as indicated by reference numeral 22. The shock wave expands in subsequent moments of time as indicated by the advancing wave fronts of the shock wave at 24 and 26. The shock wave strikes the internal surface of the cavity at a critical angle and substantially all of the energy from the shock wave undergoes internal reflection so that the shock wave is directed vertically downwardly toward opening 20 which is formed in wall 12 of the silencer 10. A short section of pipe 28 conducts the shock wave energy from opening 20 into a sound-absorption medium 30.

It is also intended that the shock wave energy be delivered, along a connecting conduit 32, to a utilization device 34 so that the sonic energy of the sound wave may be translated to useful mechanical energy. For example, this energy may do useful work such as small arms bolt movement.

As will now be appreciated from an understanding of the invention, a gun silencer construction is presented which operates on the principles of internally reflecting a shock wave so that its energy may be directed and concentrated at an exit port where sound-absorption material is contained. In addition, an optional utilization of the shock wave energy is its conversion to mechanical energy where it can perform useful mechanical work for a weapon.

It should be understood that the invention is not limited to the exact details of construction shown and described herein for obvious modifications will occur to persons skilled in the art.

I claim:

1. A method of silencing gun fire comprising the steps:

positioning a gun barrel within a cavity defined by the equation $r=r_0e^{\theta/\text{tanarcsine } V_1/V_2)}$ where r is the radius, $r_0$ is a scaling factor equal to a minimum radius, e is the base of natural logarithms, $\theta$ is the angle, $V_1$ is the velocity of sound in air, and $V_2$ is the velocity of sound within the wall of the cavity, wherein the end of the gun barrel is positioned such that the end is centered on the zero radius point for said cavity;

providing an exit for a fired projectile along a path in alignment with the barrel;

forming an opening in the cavity at a point along the surface thereat to which the totally reflected shock wave is directed by the wall of the cavity thereby permitting concentrated passage of sonic energy outwardly from the cavity.

2. The method set forth in claim 1 together with the step of conducting the substantially totally reflected sonic energy to a sound-absorption material for muzzling the gun fire.

3. The structure set forth in claim 2 together with the step of translating the sonic energy leaving the cavity to usable mechanical energy.

4. The method set forth in claim 1 together with the step of translating the sonic energy leaving the cavity to usable mechanical energy.

5. A gun silencer comprising:

a wall enclosing a cavity having a cross-sectional shape defined by the equation $r=r_0e^{\theta/\tan(\text{arcsine } V_1/V_2)}$ where r is the radius, $r_0$ is a scaling factor equal to a minimum radius, e is the base of natural logarithms, $\theta$ is the angle, $V_1$ is the velocity of sound in air, and $V_2$ is the velocity of sound within the wall of the cavity;

a first opening for receiving a gun barrel, wherein the end of the gun barrel is positioned such that the end is centered on the zero radius point for said cavity;

a second opening, in alignment with the first providing an exit for a fired projectile, the cavity substantially totally internally reflecting a shock wave produced by gun firing so that the wave is directed to a point on the cavity surface; and a third opening formed at the point for permitting passage of the wave outwardly from the cavity.

6. The structure set forth in claim 1 together with means connected to the third opening for directing an exiting shock wave to a sound-absorption material.

7. The structure set forth in claim 6 together with means connected to the third opening for directing an exiting shock wave to a utilization device for translating sonic energy to useful mechanical energy.

8. The structure set forth in claim 1 together with means connected to the third opening for directing an exiting shock wave to a utilization device for translating sonic energy to useful mechanical energy.

9. The structure set forth in claim 1 wherein the angle $\theta$ is defined between 0° and 180°.

* * * * *